United States Patent [19]

Reynolds

[11] Patent Number: 5,060,552

[45] Date of Patent: Oct. 29, 1991

[54] RAIL GUNS

[75] Inventor: Graham A. Reynolds, Coventry, England

[73] Assignee: Rolls-Royce Business Ventures Limited, Derby, England

[21] Appl. No.: 573,823

[22] Filed: Aug. 28, 1990

[30] Foreign Application Priority Data

Oct. 13, 1989 [GB] United Kingdom ..... 8923114

[51] Int. Cl.[5] ..... F41B 6/00

[52] U.S. Cl. ..... 89/8; 89/14.1; 124/3

[58] Field of Search ..... 42/76.01; 89/8, 14.05, 89/14.1; 124/3

[56] References Cited

U.S. PATENT DOCUMENTS 785,975 3/1905 McClean ..... 42/76.01

FOREIGN PATENT DOCUMENTS 251799 10/1988 Japan ..... 89/14.1

*Primary Examiner*—Stephen C. Bentley

*Attorney, Agent, or Firm*—Oliff & Beridge

[57] ABSTRACT

A rail gun (10) comprising two spaced apart elongate co-extensive rail electrodes (11,12) having confronting surfaces which are of toothed cross-section configuration. Alternate tooth flanks (21) have the outlets of a plurality of nozzles (24) located therein. The nozzles (24) direct helium into the gap (14) between the rail electrodes (11,12). The helium provides electrode (11,12) cooling as well as providing less resistance to armature (15) acceleration than would be the case with air.

13 Claims, 2 Drawing Sheets

RAIL GUNS

This invention relates to rail guns and in particular to the electrodes of rail guns.

A rail gun conventionally comprises two parallel rail electrodes between which is placed an electrically conductive projectile or an armature arranged to propel a projectile. When a very large electric current is passed between the electrodes via the electrically conductive projectile or armature, intense electric and magnetic fields are established. This results in the acceleration of the electrically conductive projectile or armature along the gap between the rail electrodes by the force resulting from the interaction between the magnetic field between the rail electrodes and the moving charge particles in the electrically conductive projectile or armature.

Rail guns or moving charge particles as they are sometimes known, can be used as effective weapon systems. If an electric current of sufficient magnitude is passed through the rail electrodes and the electrically conductive projectile or armature, very high levels of projectile acceleration can be achieved. However it has been found that the utilisation of such large currents can result in the undesirable overheating of the rail electrodes placing a serious limitation on their life.

It is an object of the present invention to provide a rail gun having rail electrodes which are less prone to such undesirable overheating.

According to the present invention, a rail gun comprises two elongate co-extensive generally equally spaced apart electrodes for carrying an electric current, each of said electrodes defining a surface which confronts a corresponding surface on the other electrode to facilitate electrical contact between said electrode surfaces and an electrically conductive armature operationally located between said electrodes, each of said confronting surfaces having a plurality of grooves therein extending generally transversely to the longitudinal extents of said electrodes, means being provided in each groove to direct a cooling fluid into that groove and thence to the space between said rail electrodes to provide cooling of said rail electrodes.

Figure 1:
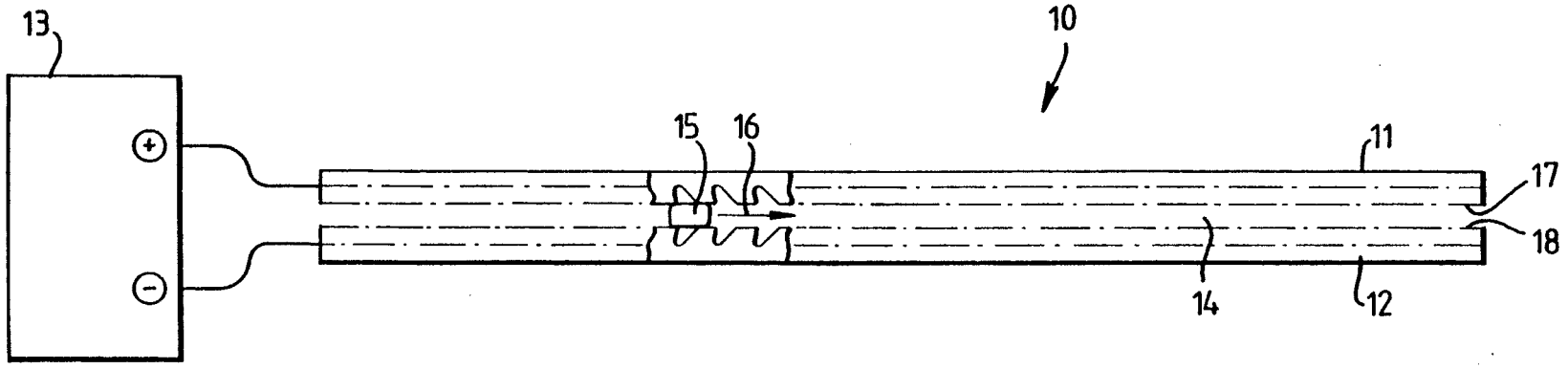

The invention will now be described, by way of example, with reference to the accompanying drawings in which FIG. 1 is a diagrammatic view of the essential features of a rail gun in accordance with the present invention.

Figure 2:
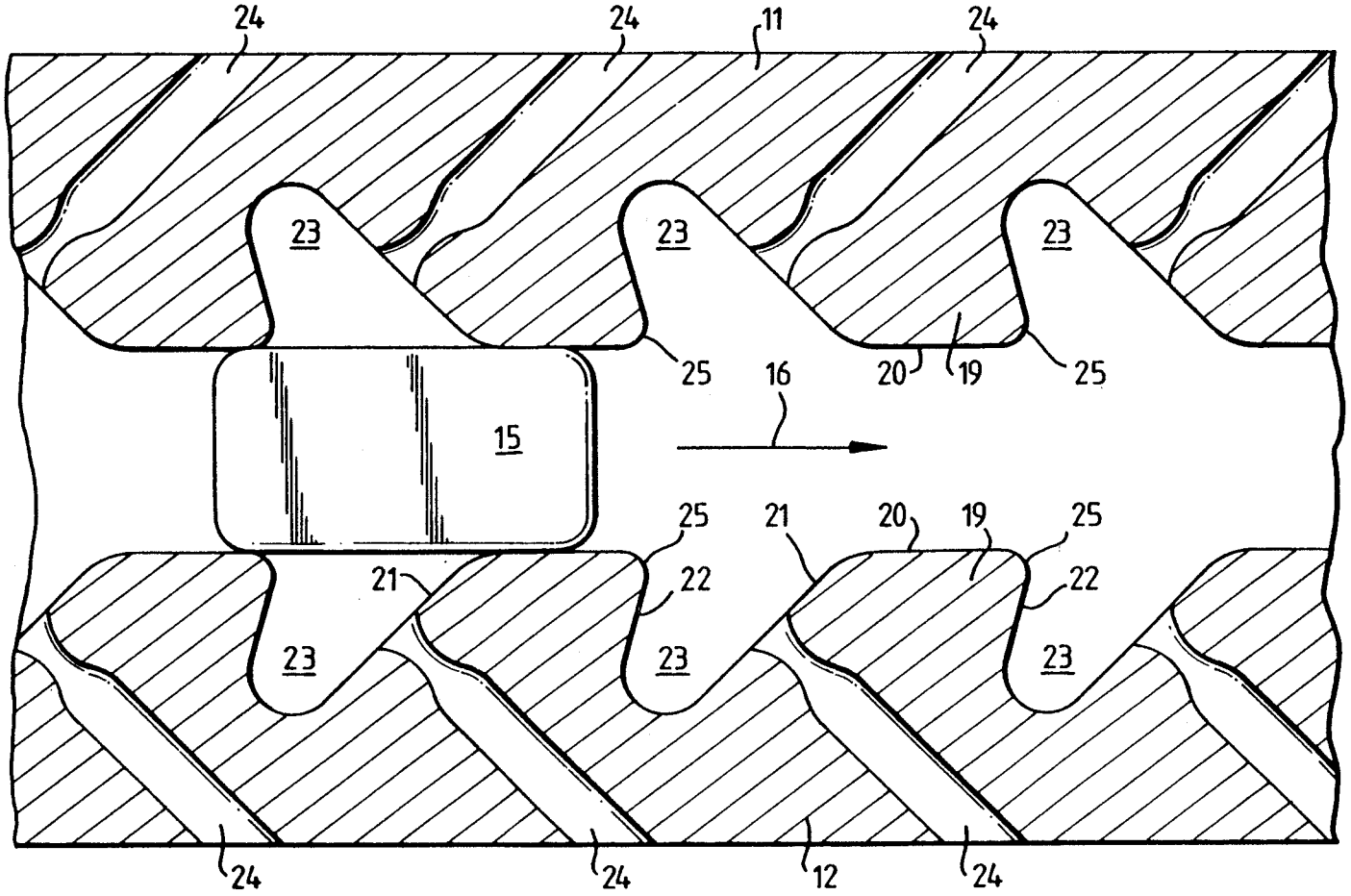

FIG. 2 is a sectioned side view on an enlarged scale of a portion of the rail electrodes of the rail gun shown in FIG. 1 showing an armature located between the rail electrodes.

With reference to FIG. 1, a rail gun 10 comprises two elongate, co-extensive rail electrodes 11 and 12 which are connected to a source of very large DC electrical output 13 so as to be of opposite polarity. A suitable source could for instance, by a homopolar generator.

The rail electrodes 11 and 12 are equally spaced apart to define a gap 14 for the reception of an electrically conductive armature 15. The armature 15 may be in the form of a projectile or alternatively it may be used to propel a projectile (not shown). The armature 15 is in electrical contact with the rail electrodes 11 and 12 so that during the operation of the source of very high electrical output 13, current flows from one rail electrode 11 to the other rail electrode 12 via the armature.

Intense electric and magnetic fields resulting from the current flow cause rapid acceleration of the armature 15 indicated by the arrow 16 until it is ejected at very high velocity from the rail gun 10.

It will be appreciated that although only the rail electrodes 11 and 12 of the rail gun 10 are depicted in FIG. 1, other constraining means in the form of a gun barrel (not shown) in which the rail electrodes 11 and 12 are located are present to ensure that the armature 15 follows the correct path between the rail electrodes 11 and 12.

The confronting surfaces 17 and 18 of the rail electrodes 11 and 12 respectively are of similar regular toothed cross-section configuration as can be seen more clearly if reference is now made to FIG. 2. Each tooth 19 extends transversely to the longitudinal extent of its respective rail electrode 11,12 and is provided with a face 20 which confronts and is parallel with a corresponding face 20 on a tooth 19 on the other rail electrode 11,12 so that the teeth 19 on the rail electrodes 11 and 12 are aligned with each other. The tooth faces 20 on each rail electrode are coplanar and equally spaced apart from other tooth faces 20 on the same rail by a distance which is less than the longitudinal extent of the armature 15.

The leading flank 21 of each tooth 19 (with respect to the direction 16 of armature 15 travel) is inclined at an angle of approximately 135° to the plane of the tooth confronting face 20. The trailing flank 22 of each tooth 19 is however inclined to the tooth confronting face 20 by an angle which is somewhat less than 90°.

The toothed configuration of the rail electrodes 11 and 12 ensures that as the electric current flows between the rail electrodes 11 and 12 via the armature 15, there is not a concentration of the current and consequent overheating in the region of the rail electrode surfaces 17 and 18. Instead the current follows a generally linear path along those portion of the rail electrodes 11 and 12 which are remote from the toothed regions thereof. In the regions of the teeth 19 the current is deflected from its generally linear path to flow through each tooth 19.

Notwithstanding the reduction in heating of the rail electrodes 11 and 12 as a result of their toothed configuration, it is still possible that some overheating of the rail electrodes 11,12 could occur. In order to counter this problem, each of the transversely extending grooves 23 defined by the leading and trailing flanks 21 and 22 respectively of the teeth 19 is supplied with a flow of gaseous helium. Helium is supplied to each groove 23 via a plurality of nozzles 24. Each nozzle 24 is of convergent/divergent configuration, so as to provide high exit velocities, and exhausts from a leading tooth flank 21. Each of the nozzles 24 is so positioned that it directs a high velocity jet of helium on to the edge 25 defined by a confronting tooth face 20 and its associated trailing flank 22.

The edge 25 of each tooth 19 is a critical region since it is the final point of contact between each tooth 19 and the armature 15 as the armature 15 travels in the direction indicated by the arrow 16. Consequently there is a tendency for arcing to occur between the edges 25 and the armature 15 which results in localised overheating of the rail electrodes 11 and 12. Arcing is reduced to a certain extent by the edges 25 being rounded. However the high velocity jet of helium serves to extinguish the arcing, thereby reducing the problem of overheating.

Since the helium nozzles 24 are located within the rail electrodes 11 and 12, the passage of helium through the nozzles 24 provides generalised cooling of the rail electrodes 11 and 12. Moreover, the general flow of helium through the grooves 23 and along the space between the rail electrodes 11 and 12 provides further cooling of the rail electrode 11 and 12.

In practice the space 14 between the rail electrodes 11 and 12 is flushed with helium from the nozzles 24 prior to the operation of the rail gun 10. Since helium is less dense than air, it is capable of being compressed to a greater extent than air. This ensures in turn that the velocity of the armature 15 as it exits the rail gun 10 is higher than would have been the case if air along had been present within the rail gun 10.

Although the present invention has been described with a reference to rail electrodes 11 and 12 which are of toothed cross-section configuration, it will be appreciated that this need not necessarily be the case. Thus the present invention could be generally applied in a form embodying rail electrodes 11 and 12 which have transverse grooves into which a cooling fluid, such as helium, is directed.

I Claim:

1. A rail gun comprising two elongate co-extensive generally equally spaced apart electrodes for carrying an electric current, each of said electrodes defining a surface which confronts a corresponding surface on the other electrode to facilitate electrical contact between said electrode surfaces and an electrically conductive armature operationally located between said electrodes, each of said confronting surfaces having a plurality of grooves therein extending generally transversely to the longitudinal extents of said electrodes, means being provided in each groove to direct a cooling fluid into that groove and thence to the space between said rail electrodes to provide cooling of said rail electrodes.

2. A rail gun as claimed in claim 1 wherein said cooling fluid is directed into each of said grooves via a plurality of nozzles, the outlets of which nozzles are located within said grooves.

3. A rail gun as claimed in claim 2 wherein each of said grooves is provided with a leading flank and a trailing flank with respect to the operational passage of an armature through said rail gun, the outlets of said nozzles being located in the leading flanks of said grooves.

4. A rail gun as claimed in claim 3 wherein the angle between each leading flank and said confronting surface adjacent thereto is approximately 135°.

5. A rail gun as claimed in claim 3 wherein the angle between each trailing flank and said confronting surface adjacent thereto is less than 90°.

6. A rail gun as claimed in claim 2 wherein said nozzles are located within the rail electrodes of said rail gun.

7. A rail gun as claimed in claim 2 wherein each of said nozzles is so aligned as to direct said cooling fluid on to the edge defined by the trailing edge flank adjacent thereto and the confronting surface of its associated rail electrode.

8. A rail gun as claimed in claim 7 wherein said defined edge is rounded.

9. A rail gun as claimed in claim 2 wherein each of said cooling fluid nozzles is of convergent/divergent configuration.

10. A rail gun as claimed in claim 1 wherein said cooling fluid is helium.

11. A rail gun as claimed in claim 1 wherein said grooves are so spaced apart that each of said rail electrode confronting surfaces is of toothed cross-section configuration.

12. A rail gun as claimed in claim 11 wherein the teeth defined by said toothed cross-section configuration are of similar configuration and equally spaced apart along the longitudinal extents of said rail electrodes.

13. A rail gun as claimed in claim 12 wherein said teeth on one of said rail electrodes are aligned with said teeth on the other of said rail electrodes.

* * * * *